United States Patent [19]

Jürgensmeyer et al.

[11] Patent Number: 4,586,360

[45] Date of Patent: May 6, 1986

[54] METHOD OF AND APPARATUS FOR THE FINE CUTTING (PUNCHING) OF ARTICLES

[75] Inventors: Willi Jürgensmeyer, Wuppertal; Friedrich-Wilhelm Honsberg; Kurt Halbach, both of Remscheid, all of Fed. Rep. of Germany

[73] Assignee: Dako-Werkzeugfabriken David Kotthaus GmbH & Co. KG, Remscheid, Fed. Rep. of Germany

[21] Appl. No.: 628,183

[22] Filed: Jul. 6, 1984

[30] Foreign Application Priority Data

Jul. 8, 1983 [DE] Fed. Rep. of Germany ..... 3324680

[51] Int. Cl.[4] ..... B21D 28/14

[52] U.S. Cl. ..... 72/328; 72/329; 72/338; 72/344; 72/352; 29/159.2

[58] Field of Search ..... 72/327–330, 72/333, 335, 339, 344, 354, 358, 338, 352; 29/159.2

[56] References Cited

U.S. PATENT DOCUMENTS

| | | | |
|---|---|---|---|
| 3,731,516 | 5/1973 | Dohmann et al. | 72/358 |
| 4,142,396 | 3/1979 | Deveney et al. | 72/329 |
| 4,299,112 | 11/1981 | Kondo et al. | 72/344 |

FOREIGN PATENT DOCUMENTS

| | | | |
|---|---|---|---|
| 283844 | 4/1915 | Fed. Rep. of Germany | 72/327 |
| 70426 | 5/1980 | Japan | 72/333 |
| 14439 | 1/1982 | Japan | 29/159.2 |
| 14440 | 1/1982 | Japan | 29/159.2 |
| 2661 | of 1907 | United Kingdom | 72/327 |
| 336803 | 10/1930 | United Kingdom | 72/327 |

*Primary Examiner*—Daniel C. Crane

*Attorney, Agent, or Firm*—Karl F. Ross; Herbert Dubno

[57] ABSTRACT

Fine die stamping of workpieces from sheet metal is effected by clamping the workpiece between a die plate and guide plate, supporting the portion of the material to form the article by an ejector which is displaced along with the punch, and driving the supported portion of the material into a hole in the die plate having flanks tapered away from the guide plate and punch so that swaging occurs on the separated portion with or upon its separation from the balance of the workpiece material.

8 Claims, 8 Drawing Figures

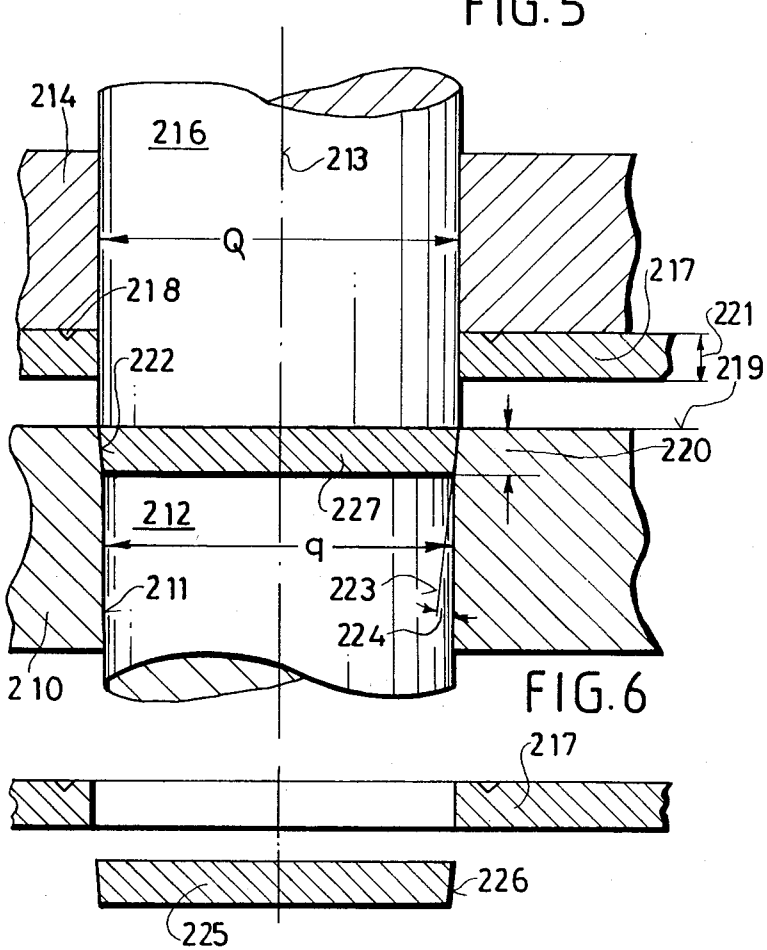
FIG. 5
FIG. 6
221
219
220
217
213
216
Q
218
222
214
227
q
223
224
212
211
210
217
226
225
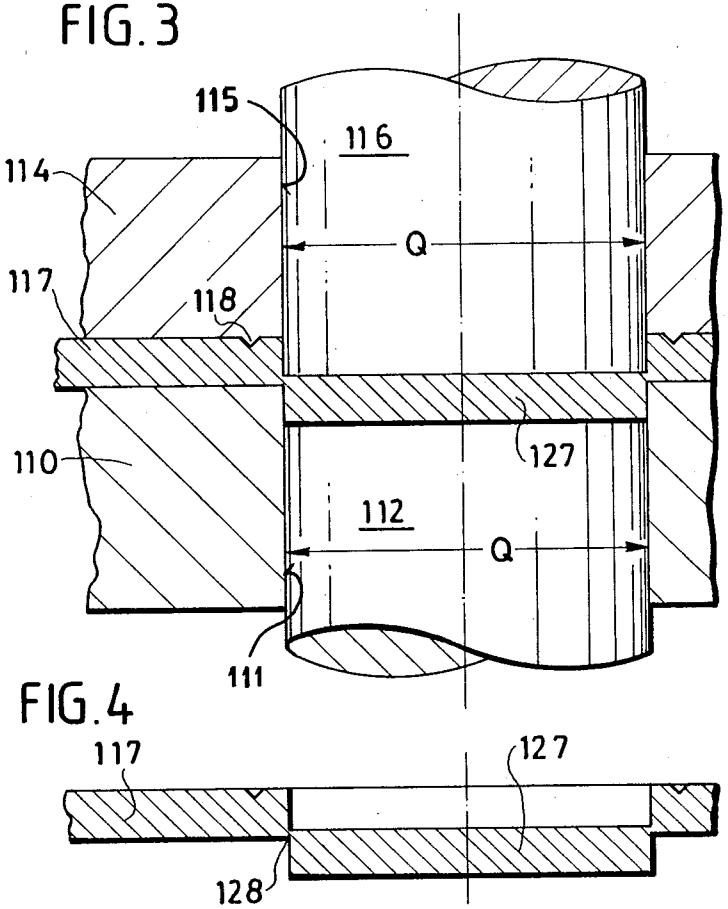
FIG. 3
FIG. 4
116
Q
115
118
114
117
110
127
Q
112
111
127
128
117

METHOD OF AND APPARATUS FOR THE FINE CUTTING (PUNCHING) OF ARTICLES

FIELD OF THE INVENTION

Our present invention relates to a method of and to a tool for the fine cutting of workpieces and particularly for the fine stamping or punching of workpieces from a piece of material utilizing a punch or stamp plunger and a cutting plate or die plate formed with a recess having generally the shape of the article to be formed by the punching and stamping operation.

BACKGROUND OF THE INVENTION

As used herein, the term "fine cutting" is intended to describe a high-precision stamping or punching of articles from sheet material, especially metal objects from metal strip, utilizing a punch having the profile of the article to be produced, and a cutting plate or die plate having an opening of complementary profile.

While generally punching and stamping are coarse processes capable only of producing blanks or articles which may be further shaped and which may deviate significantly in size or shape from the desired article, owing to deformation of the material to be punched, the inability to effectively control distortion during the punching or stamping operation, and other factors in the operation, a high quality punching and stamping process and tool has been developed for what can be described as fine stamping or fine punching.

In the latter system articles can be shaped to narrow tolerances because the workpiece is firmly held all around the hole and the punch during the step of driving the material into the hole which constitutes the punching operation.

In such a system a guide plate is juxtaposed with the die plate or cutting plate, the material, e.g. steel strip of a thickness of 0.3 millimeters to about 15 millimeters is fed between this guide plate and the die plate, the two parts clamp the material between them. A punch shiftable in the guide plate is displaced in registry with a hole of predetermined size and shape complementary to the size and shape of the punch, to drive the material through the hole and shear it from the strip. To support the material against distortion while it is being pressed through the hole, the article is supported during the stamping operation by an ejector which can have generally the same shape as the punch and between which the article is clamped during the displacement with the article from the strip. In other words around the perimeter of the hole, the material is supported by clamping it between the two plates while within the outline or perimeter of the hole, the material is supported by clamping it between the punch and the ejector.

The guide plate and/or the die cutting plate can be provided with an annular tooth or barb which can penetrate into the strip close to the periphery of the hole to prevent lateral displacement of the material during the stamping operation.

The resistance exerted by the ejector to the displacement of the stamping ram can amount to 10 to 20% of the cutting force which must be developed by the punch. This ensures that from the initial displacement of the material, the portion of the material which is adapted to form the article remains firmly clamped between the punch and the ejector.

The principles of fine cutting, the state of the art relevant thereto and the guide lines involved will be apparent from the publication VDI 3345 "FEINSCHNEIDEN" May 1980 (VDI Guidelines).

Because of the close tolerances required between the punch and hole in the die plate, generally the punch does not enter this hole and on the edges of the workpiece turned toward the punch thin burrs may remain. The bore in the guide plate in which the punch is displaced generally also has the same shape and size as the hole into which the article is forced in the punching operation.

OBJECTS OF THE INVENTION

It is the principal object of the present invention to provide a fine punching or fine stamping method capable of producing by a fine cutting operation of the type described, articles of especially high fabrication tolerances and in a manner which improves upon earlier methods.

Another object of this invention is to provide an improved tool for the stamping of articles from sheet metal and especially sheet or strip steel of the thicknesses set forth previously.

SUMMARY OF THE INVENTION

These objects and others which will become apparent hereinafter are obtained, in accordance with the present invention in a method of fabricating articles by a fine stamping operation in which a sheet workpiece, e.g. steel band or strip, is clamped between a guide plate and a die plate in the manner described, a punch is displaceable in the guide plate in alignment with a cavity of complementary configuration and dimensions and the workpiece is engaged between this punch and an ejector so that the article as it is formed is also clamped, and the article pressed out of the strip or sheet material is pressed into a cavity which has at least some conical or wedge-shaped tapered flanks at least over a portion of the periphery so that such inclined flanks are complementarily imparted to the workpiece.

The invention has been found to be especially applicable to the fabrication of gear wheels, star wheels, spur wheels and cog wheels (hereinafter collectively referred to as toothed wheels) and whose teeth have flanks which are not parallel in an axial sense, but rather are inclined toward one another in a given direction and at a given angle.

Thus an aspect of the invention resides in the formation of toothed wheels whose flanks are inclined in this way to the axis of rotation.

It should be noted that the invention also includes a system in which apart from defining the outer periphery of the article via the outer configuration of the stamp and the complementary hole, either the stamp (punch) or the ejector can be provided with inner punch elements while the other is provided with a complementary hole to define an inner periphery of an annular article or various holes or like formations in the article within the extenernal outline.

According to one embodiment of the invention the hole initially juxtaposed with the punch is provided with flanks conically converging away from the punch so that the size of the hole at its side confronting the punch is larger than the size of the hole turned away from the punch while the punch has a size and configuration corresponding to that of the hole at its side turned toward the punch. In this case, the punching operation, i.e. the physical separation of the article from the workpiece coincides with the step of driving the workpiece into the inclined flank hole. The workpiece is thereby internally compressed during the punching operation while being clamped between the punch and the ejector and is in effect coined so as to expand slowly along the punch axis and uniformly over the entire area between the punch and the ejector.

According to a feature of the invention the inner surface of the workpiece contour defined by the die plate forms coining, swaging or embossing surfaces over at least part of the periphery to a depth so that it is preferably equal to the thickness of the articles which are inclined in the stamping direction to the ejector axis.

By contrast with the usual fine punching and stamping tools, the generatrix of the inner surface of the article defining contour of the die plate does not remain parallel to the ejector axis but rather is inclined away from the surface on which the workpiece rests initially with a convergence toward the ejector axis of predetermined conicity or inclination equal to the inclination which is desired to remain at the workpiece periphery.

At least the portion of the hole of the die plate turned toward the workpiece or material is thus formed as a swaging die which comprises the punched article inwardly. Advantageously, this portion of the hole has a height (axial dimension) slightly greater than the thickness of the workpiece material to allow this material to flow in the direction of the axis during the swaging step.

Naturally, one of the important advantages of the present invention is that it allows the fabrication of articles with completely or partially inclined flanks during the punching operation and without separate or special machining operations. The method utilizes a relatively simple apparatus and indeed can utilize a converging die plate which can be machined to provide the taper.

Sometimes problems are encountered with very thin materials or in the punching of rings having relatively small area without the intrinsic stability required for a combined stamping or swaging operation. In these cases we may utilize a two step process whereby, in a first step, the article is partially stamped from the workpiece by conventional fine stamping processes utilizing a die plate whose hole is not provided with one tapered flank. This die plate is then replaced by a die plate whose hole has tapered flanks and the punching operation is continued or completed to effect the swaging and the separation of the article from the workpiece material.

Both steps can of course be carried out in a single machine in succession. In practice the first step does not differ significantly from the fine cutting process for the production of a partial stamping (see VDI-Richtlinien page 7, 3.6 Umformvorgänge Example 6 ff).

The only difference is that the partially expressed material corresponds to the finished workpiece in this standard process. With the present invention the partially expressed article is then swaged in the swaging die hole.

BRIEF DESCRIPTION OF THE DRAWING

The above and other objects, features and advantages of the present invention will become more readily apparent from the following description, reference being made to the accompanying drawing in which:

FIG. 3 is an axial cross-sectional view similar to FIG. 1 illustrating the first stage of a two-stage process embodying the invention;

FIG. 4 is a section through the finished article;

FIG. 5 is a section similar to FIG. 3 but illustrating the punching of the article from the workpiece material and the swaging in the second step;

FIG. 6 illustrates the separation of the article from the material from which it is punched;

SPECIFIC DESCRIPTION

Figure 1:
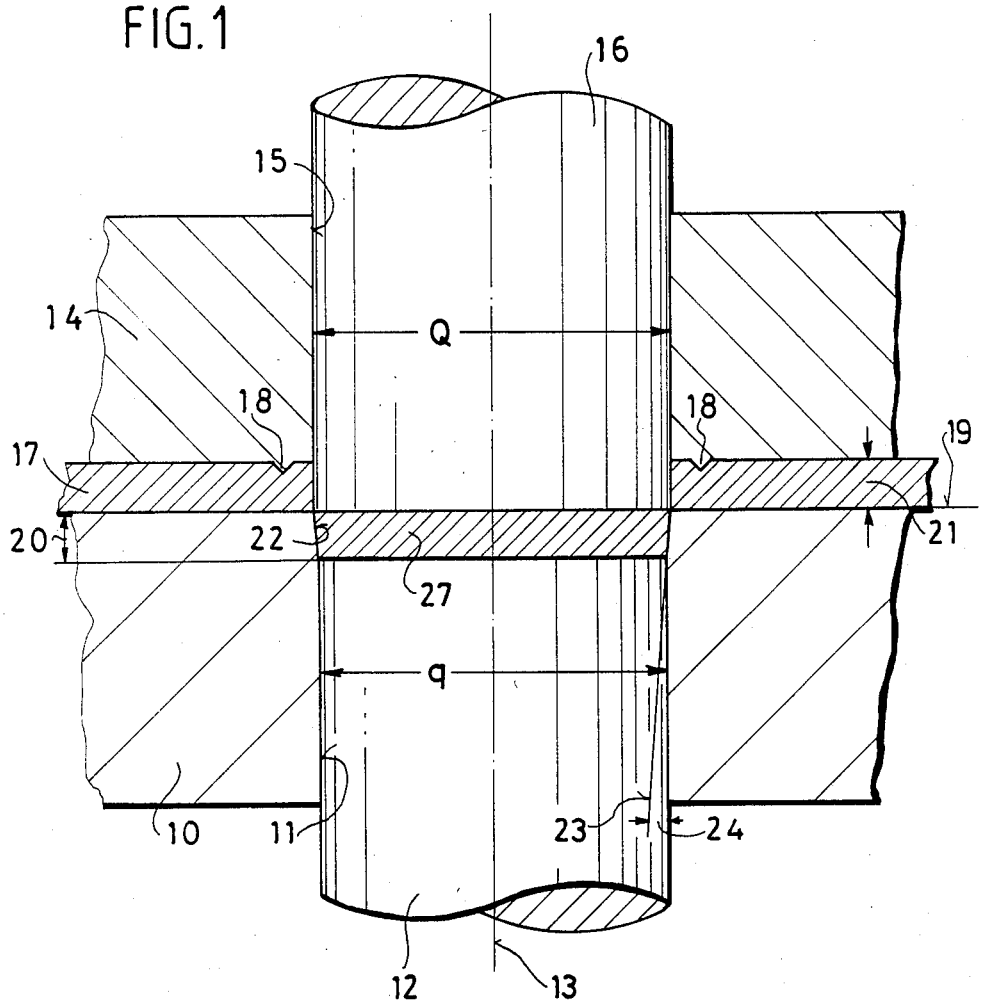
FIG. 1 is a diagrammatic axial section through a stamping tool for punching articles with tapered flanks according to the invention.
Figure 2:
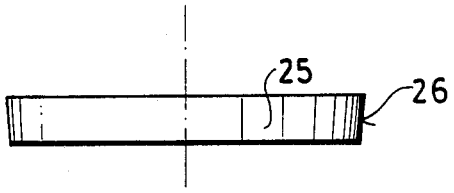
FIG. 2 is an elevational view of such an article.

The tool shown in FIG. 1 comprises, as is usually the case, a cutting or die plate 10 which is juxtaposed with a guide plate 14 and is provided with a hole 11 which has a contour 22 corresponding to the shape of an article 25 to be produced by stamping therein. The hole 11 receives an ejector 12 of complementary profile which is displaceable along the punch axis 13.

Similarly, the guide plate 14 is provided with a hole 15 of the same contour and dimensions as the end of the hole 14 turned toward the punch 16 of complementary configuration which is displaceable in this hole. The punch 16 is, of course, coaxial with the ejector 12. Naturally, an inner die can be formed within the punch 16 which can receive a receptive ejector while an inner punch is disposed within the ejector 12 to punch out the center, for example, of a gear wheel which can be fabricated by the punch and can have the configuration shown in FIGS. 7 and 8. In this case the tool can operate in accordance with the 2.1 working principle of page 2 of the VDI guidelines 3345 previously mentioned.

The workpiece 17 can be a sheet steel strip which is fed between the plates 10 and 14 and can be engaged by an annular tooth or barb 18 which bites into the workpiece directly around the contour 22 and prevents extrusion outwardly of the workpiece material.

The article contour 11 formed in the die plate 110 is tapered away from the punch 16 over an axial length 20 that is slightly less than the thickness 21 of the workpiece material. It has its largest cross section in the plane 19 of contact between the die plate 10 and the material 17. The conical flanks have been illustrated at 22.

The term "conical" has been used herein to describe the taper because the articles which are fabricated are generally round. However, when a polygonal article is made, the taper may have a wedge configuration, i.e. can include linear flanks with planar convergence.

The smaller cross section of the contour 11 has been represented at q while the larger cross section or diameter is represented at Q. The punch 16 has the larger cross section whereas the ejector 12 has the smaller cross section or diameter. The inclination or angle of taper 24, shown with respect to a generatrix 23 of the conical taper can be 3° to 4°.

As can be seen from FIG. 5 a circular article 25 can have the frustoconical flank 26.

The piece 27 adapted to form the article is pressed between the ejector 12 and the punch 16 as it is driven out of the workpiece 17 and into the swaging die 22 within the die plate. FIG. 1 illustrates the end position from whence the tool is opened and the ejector 12 drives the article in the opposite direction.

The tool shown in FIG. 1 can be utilized in a conventional fine punching machine and with the customary operating sequence.

An unpunched workpiece 17 is inserted between the die plate 10 and the guide plate 14 and these plates are moved toward one another to clamp the workpiece tightly between them, driving the tooth 18 into the workpiece.

The punch 16 and the ejector 12 are then displaced toward one another and against the workpiece to clamp the portion of the workpiece 17 which will ultimately form the article 25 between them. While the counter pressure of the ejector 12 is applied, the punch 16 is advanced forward the die plate to cut the article 25 free from the workpiece 17 and swage it with the desired taper in the swaging zone 22. After the single step punching and swaging, the die plate and guide plate can be separated from one another, the punch 16 retracted and the ejector 12 raised to eject the finished article.

FIG. 3 shows the first stage of a two-stage method. In this system, the die plate 110 is provided with the ejector 112 while the guide plate 114 has the tool 118 and the punch 116. The punch 116 is here of the same cross section Q as the ejector 112 and the bore 111 is of the same cross section as the bore 115, i.e. the die plate hole does not have a taper.

The partially pressed portion 127 of the workpiece 117 results after the punch 116 has been advanced, partially through the workpiece 117 by a punching process otherwise similar to that described in connection with FIG. 1. The ejector 112 supports the portion 127 to enable its withdrawal from the die plate 110 and the die plate 110 is replaced by a swaging plate 210.

With the section 127 connected at the ligature 128 to the remainder of the workpiece 117 the die plate is replaced by the swaging plate 210 which has the tapered hole 222 over length 220 slightly greater than the width of the portion 127.

The swaging plate 210 and the guide plate 214 are again clamped against the workpiece 217. This thickness 221 is slightly less than the dimension 220 previously described.

Once the ejector 212 and the punch 216 have clamped the portion 127 of the workpiece between them, the punch is advanced to cut loose the article 225 which is simultaneously swaged to receive the tapered flank 226 in the formation of the article 225 (FIG. 6).

The tool can then be opened and the workpiece ejected by the ejector 212. The common axis 213 of the punch and the ejector, the generatrix 223, the angle 224 and the plane 219 all correspond to the elements described in connection with FIG. 1, and identified by corresponding reference numerals without the hundreds digit.

Figure 7:
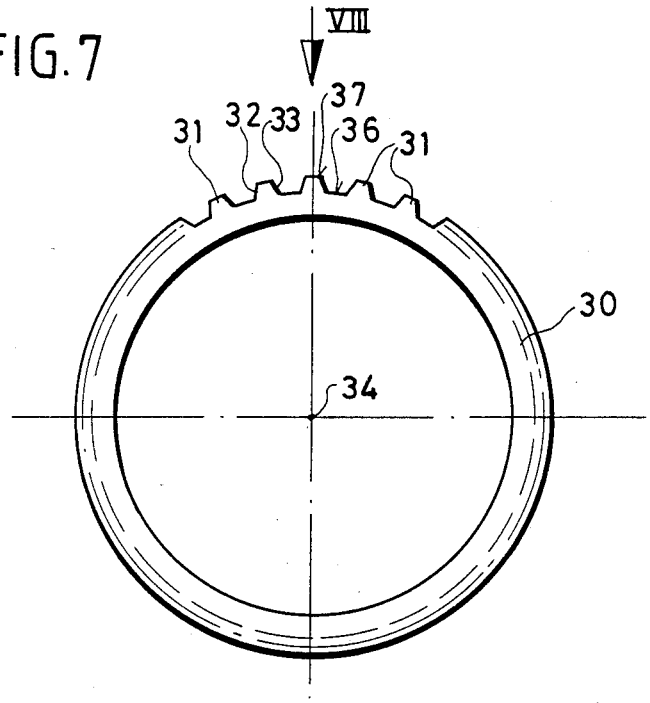
FIG. 7 is an elevational view of an externally toothed ring which can be fabricated utilizing the principles of the invention.
Figure 8:
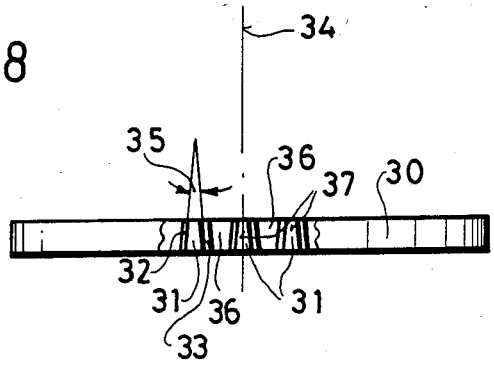
FIG. 8 is a view in the direction of the arrow VIII of the article of FIG. 7.

In FIGS. 7 and 8 we have shown diagrammatically a typical article which can be fabricated by the fine punching operation of the invention and which can comprise an external toothed ring-shaped wheel 30 whose teeth 31 have flanks 32 and 33 (FIG. 8) which are inclined at angles 35 to one another and have a certain conicity with respect to the rotation axis 34. The roots 36 between the teeth and the heads 37 of the teeth can have generatrices which lie parallel to the axis 34. Naturally, only part of the periphery of a workpiece need be tapered, in accordance with the invention, and with the appropriate construction of the swaging and punching portions it is possible to apply tapers to internal surfaces as well.

We claim:

1. A method of fine cutting an article from a flat workpiece, comprising the steps of:

clamping said workpiece between a die plate and a guide plate, said die plate having a hole having the configuration of said article with the wall of the hole defined by at least some flanks tapered away from said guide plates so that the hole decreases in cross-section away from the guide plate, said workpiece being clamped so that a portion of said workpiece lies across said hole and a remainder of said workpiece is clamped between the die plate and guide plate;

supporting said portion of said workpiece lying across said hole with an ejector; and punching said portion of said workpiece from the remainder of said workpiece into said hole with a punch having a cross section complementary to the cross section of said hole at a side thereof turned toward said guide plate by displacing said punch in said guide plate toward said die plate while continuing to support said portion with said ejector, thereby separating said portion from the remainder of the workpiece and simultaneously with the separation of said portion, swaging it to have tapered flanks in said hole and to form said article.

2. The method defined in claim 1 wherein said portion is pressed from said workpiece into said hole and is swaged therein in a single continuous operation of said punch.

3. The method defined in claim 1 wherein said portion is first pressed partially from said remainder of said workpiece in a first step by a punch in a hole without tapered flanks and is then swaged in a second step in said hole with tapered flanks.

4. A tool for the fine punching of workpieces having tapered flanks, comprising:

a guide plate having a workpiece clamping surface;

a die plate juxtaposed with said guide plate and having a workpiece clamping surface defining a plane and positioned relative to said guide plate clamping surface to clamp a flat workpiece thereagainst, said die plate being formed with a hole having a contour provided with at least some flanks tapering away from said plane of contact of said die plate with said workpiece and extending to said plane, said taper being such that the cross-section of said hole decreases from said plane to a position spaced away from said plane;

an ejector displaceable in said hole for supporting a portion of a workpiece adapted to be punched into said hole; and a punch aligned with said ejector and having a cross section complementary to that of said hole at said plane, means for movably mounting both said punch and ejector so that said punch severs said portion from the remainder of said workpiece and drives it into said hole while said portion is supported by said ejector for swaging said portion immediately during the severing of said portion to impart a taper thereto and form said article.

5. The apparatus defined in claim 4 wherein said tapered flanks have a length slightly greater than the spacing between said plates upon clamping of the workpiece between them prior to the swaging of said portion.

6. The apparatus defined in claim 4, further comprising another die plate for initially deforming said portion from said remainder of said workpiece prior to the swaging of said portion.

7. The apparatus defined in claim 4 wherein said guide plate is formed with an annular barb of triangular cross section tapering in the direction of the said die plate and impressing a groove in said workpiece when said workpiece is claimed between said plates, said die plate being flat opposite said guide plate.

8. A method of fine cutting an article from a flat workpiece, comprising the steps of:

clamping said workpiece between a die plate and a guide plate, said die plate having a hole having the configuration of said article with the wall of the hole defined by at least some flanks tapered away from said guide plate so that the hole decreases in cross-section away from the guide plate, said workpiece being clamped so that a portion of said workpiece lies across said hole and a remainder of said workpiece is clamped between the die plate and guide plate, said guide plate having an annular barb which is pressed into and embosses said workpiece outwardly of and coaxial with said hole upon the clamping of said workpiece between said die plate and said guide plate, said guide plate being flat opposite said barb;

supporting said portion of said workpiece lying across said hole with an ejector; and punching said portion of said workpiece from the remainder of said workpiece into said hole with a punch having a cross section complementary to the cross section of said hole at a side thereof turned toward said guide plate by displacing said punch in said guide plate toward said die plate while continuing to support said portion with said ejector, thereby separating said portion from the remainder of the workpiece and simultaneously with the separation of said portion, swaging it to have tapered flanks in said hole and to form said article.

* * * * *